US006379425B1

(12) United States Patent
Kikuchi et al.

(10) Patent No.: US 6,379,425 B1
(45) Date of Patent: Apr. 30, 2002

(54) METHOD OF DESULFURIZING MOLTEN IRON

(75) Inventors: Naoki Kikuchi; Shuji Takeuchi; Akiharu Takao; Mototatsu Sugizawa; Shigeru Ogura, all of Chiba (JP)

(73) Assignee: Kawasaki Steel Coporation, Hyogo (JP)

( * ) Notice: Subject to any disclaimer, the term of this patent is extended or adjusted under 35 U.S.C. 154(b) by 0 days.

(21) Appl. No.: 09/588,465

(22) Filed: Jun. 6, 2000

(30) Foreign Application Priority Data

Jun. 7, 1999 (JP) ..... 11-159369

(51) Int. Cl.[7] ..... C21C 5/30
(52) U.S. Cl. ..... 75/529
(58) Field of Search ..... 75/529, 530

(56) References Cited

U.S. PATENT DOCUMENTS 3,843,354 A * 10/1974 Nilles et al. ..... 75/539
3,998,625 A 12/1976 Koros
4,592,777 A 6/1986 Rellermeyer et al.
5,873,924 A 2/1999 Kinsman et al.

FOREIGN PATENT DOCUMENTS

EP 0 974 673 1/2000
JP 2000-178626 6/2000

* cited by examiner

*Primary Examiner*—Melvyn Andrews
(74) *Attorney, Agent, or Firm*—Young & Thompson

(57) ABSTRACT

Desulfurization is carried out by blowing CaO into molten iron, and a gas mixture of an inert gas and a hydrocarbon gas is used as a carrier. The ratio of the hydrocarbon gas to the desulfurizing agent is maintained in the range of from about 2.0 to about 50 Nl/kg. This desulfurizing method improves the desulfurization efficiency of the desulfurizing agent, increases the productivity of the desulfurizing process, and reduces the amount of slag generated in the desulfurizing process. Alternatively, a desulfurizing flux is blown into the molten iron together with a carrier gas comprising a gas mixture of an inert gas and a hydrocarbon gas or an inert gas alone at the start of desulfurization. The hydrocarbon gas in the carrier gas is increased, is added, or the unit gas is replaced by the hydrocarbon gas at adequate timing, whereby the desulfurization efficiency is improved.

9 Claims, 4 Drawing Sheets

METHOD OF DESULFURIZING MOLTEN IRON

BACKGROUND OF THE INVENTION

1. Field of the Invention

The present invention relates to a method of removing a sulfur component in molten iron, and more particularly to an improved desulfurizing method that provides enhanced desulfurization efficiency.

2. Description of the Related Art

As the demand for higher quality steel materials has risen, so also has the demand for low-sulfur steel. The desulfurizing process in steel manufacturing techniques is mainly of two types, i.e., one carried out in the molten iron stage, in a torpedo car or a molten-iron pan, and the other carried out in the molten-steel stage, on deoxidized molten steel downstream of a converter. At present, it is common to carry out the desulfurizing process in both the molten-iron stage and the molten-steel stage, for extremely-low-sulfur steel in which the sulfur content of the molten steel is not larger than 10 ppm, and to carry out the desulfurizing process only in the molten-iron stage for other types of steel.

For the desulfurizing process carried out in the molten-iron stage, a CaO-based desulfurizing agent, an $Na_2O$-based desulfurizing agent, an Mg-based desulfurizing agent, etc. are employed. More specifically, in the desulfurizing process carried out in the molten-iron stage, because the CaO-based desulfurizing agent is preferred from the viewpoints of slag treatment and cost, a technique of improving the efficiency of the process for desulfurizing molten iron by the use of the CaO-based desulfurizing agent is required.

As desulfurizing is a reducing reaction, Japanese Examined Patent Application Publication No. 5-43763 discloses a method of accelerating desulfurization with hydrogen gas. According to this Publication, by employing hydrogen gas as a carrier gas used for blowing a CaO-based desulfurizinq agent, the desulfurizing reaction with the CaO-based desulfurizing agent is accelerated in comparison with the case of employing an inert gas as the carrier gas.

Also, in Japanese Examined Patent Application Publication No. 7-5953, a test is described, as a comparative example, using a hydrocarbon-based gas that also has a reducing property. As a result of the test, it is concluded that the hydrocarbon-based gas is not suitable for the desulfurizing reaction because the temperature of molten iron is lowered due to the endothermic decomposition reaction that occurs upon blowing the hydrocarbon-based gas.

Furthermore, Japanese Examined Patent Application Publication No. 63-19562 discloses a method of accelerating the desulfurizing reaction by adding a desulfurizing agent to molten iron from above and blowing a hydrocarbon-based gas thereto from below in a molten-iron trough of a blast furnace. Moreover, Japanese Unexamined Patent Application Publication No. 60-26607 discloses a method of mixing, in a CaO-based desulfurizing agent, an organic material that contains 3–20 weight % of coal-based hydrocarbon.

As noted above, when a hydrocarbon-based gas is blown into molten iron, the temperature of molten iron is lowered due to the endothermic decomposition reaction of the hydrocarbon-based gas. However, we have recognized that the efficiency of the desulfurizing reaction is improved by blowing the hydrocarbon-based gas into molten iron while holding the temperature of the molten iron at a high level. In the case of blowing the hydrocarbon-based gas into the molten iron, therefore, we have recognized that it is required to limit the amount of the hydrocarbon-based gas used in an appropriate range.

Furthermore, we have recognized that if the position at which a desulfurizing agent is blown in differs from the position at which a hydrocarbon-based gas is blown in, the desulfurizing agent and the hydrocarbon-based gas do not mix with each other sufficiently, thus resulting in reduced efficiency of the desulfurizing reaction. The method of employing, as a desulfurizing agent, an organic material containing coal-based hydrocarbon has the problems that the production cost is pushed up by an expensive cost of such an organic material, and the coal-based hydrocarbon cannot be selectively supplied depending on a sulfur concentration level of the molten iron.

SUMMARY OF THE INVENTION

With the view of solving the problems set forth above, an object of the present invention is to provide a desulfurizing method which, when the desulfurizing process is carried out by blowing a CaO-based desulfurizing agent into molten iron, can improve the desulfurization efficiency of the CaO-based desulfurizing agent, can increase the productivity of the desulfurizing process, and can reduce the amount of slag generated in the desulfurizing process.

Generally, the desulfurizing reaction of molten iron effected by a CaO-based desulfurizing agent is expressed by the following formula (1). In the formula (1), [S] denotes S (sulfur) in the molten iron. Also, [C] denotes C (carbon) in the molten iron and contributes, as a reductant, to the desulfurizing reaction in the formula (1). Further, (CaS) indicates that CaS is removed with slag.

$$[S]+CaO+[C]\rightarrow(CaS)+CO \quad (1)$$

When a hydrocarbon-based gas, which is a reducing gas, is blown into molten iron, the hydrocarbon-based gas is decomposed to produce a hydrogen gas. This reaction is expressed by the following formula (2):

$$C_nH_m\rightarrow nC+m/2H_2 \quad (2)$$

The desulfurizing reaction effected by the hydrogen gas and the CaO-based desulfurizing agent occurs as expressed in the following formula (3). The desulfurizing reaction of the formula (3) is more advantageous because of having higher reducing power than the reducing reaction effected by C in the molten iron. Considering the case where hydrocarbon (e.g., propane) contributes directly to the reaction, that case is expressed by the following formula (4), i.e., the sum of the two formulae (3) and (2) (n=3 and m=8). Thus, comparing both the desulfurizing reactions (3) and (4) in terms of free energy of the reaction, the desulfurizing reaction (4) based on hydrocarbon is more advantageous than the desulfurizing reaction (3) based on hydrogen by an amount corresponding to decomposing reaction energy of the hydrocarbon.

$$[S]+CaO+H_2\rightarrow(CaS)+H_2O \quad (3)$$

$$7[S]+7CaO+C_3H_8\rightarrow7(CaS)+4H_2O+3CO \quad (4)$$

However, because decomposition of the hydrocarbon-based gas, shown in the above formula (2), occurs as an endothermic reaction, blowing of the hydrocarbon-based gas causes a reduction in the temperature of the molten iron. In other words, blowing a large amount of the hydrocarbon-based gas reduces the temperature of the molten iron and impedes the desulfurizing reaction. It is therefore required to limit the amount of the hydrocarbon-based gas used in an appropriate range.

In view of the above, the inventors have attained new findings and-accomplished the present invention as follows.

(1) The present invention resides in a method of desulfurizing molten iron by blowing a powdery desulfurizing agent, which contains a solid oxide as a main component, into the molten iron together with a carrier gas, the method comprising the steps of using, as the carrier gas, a gas mixture of an inert gas and a hydrocarbon-based gas; and setting a ratio of the hydrocarbon-based gas to the desulfurizing agent to be in the range of 2.0 to 50 Nl/kg.

(2) In the above method of desulfurizing molten iron, preferably, a blowing rate of the desulfurizing agent is not greater than 1.0 kg/minute per ton of the molten iron.

(3) Also, the present invention resides in a method of desulfurizing molten iron by blowing a desulfurizing flux into the molten iron together with a carrier gas and removing sulfur in the molten iron, the method comprising the steps of using, as the carrier gas, a gas mixture of an inert gas and a hydrocarbon-based gas at the start of desulfurization; and increasing a proportion of the hydrocarbon-based gas in the carrier gas or replacing the carrier gas by the hydrocarbon-based gas when a sulfur concentration in the molten iron is reduced down to or below a predetermined value after the start of desulfurization.

(4) Furthermore, the present invention resides in a method of desulfurizing molten iron by blowing a desulfurizing flux into the molten iron together with a carrier gas and removing sulfur in the molten iron, the method comprising the steps of using an inert gas as the carrier gas at the start of desulfurization; and adding a hydrocarbon-based gas to the carrier gas or replacing the carrier gas by a hydrocarbon-based gas when a sulfur concentration in the molten iron is reduced down to or below a predetermined value after the start of desulfurization.

In the above method, it was found that the predetermined value of the sulfur concentration is preferably set to 0.01 wt %.

DESCRIPTION OF PREFERRED EMBODIMENTS

The inventors conducted experiments by using a 4-ton furnace in order to study the effect of a hydrocarbon-based gas upon the desulfurizing process. The experiment conditions are listed in Tables 1 and 2. A CaO-based desulfurizing agent in the form of powder was employed as a desulfurizing agent. Incidentally, the blowing rate of the desulfurizing agent is indicated by the weight of the desulfurizing agent blown per unit time (kg/minute).

Figure 4:
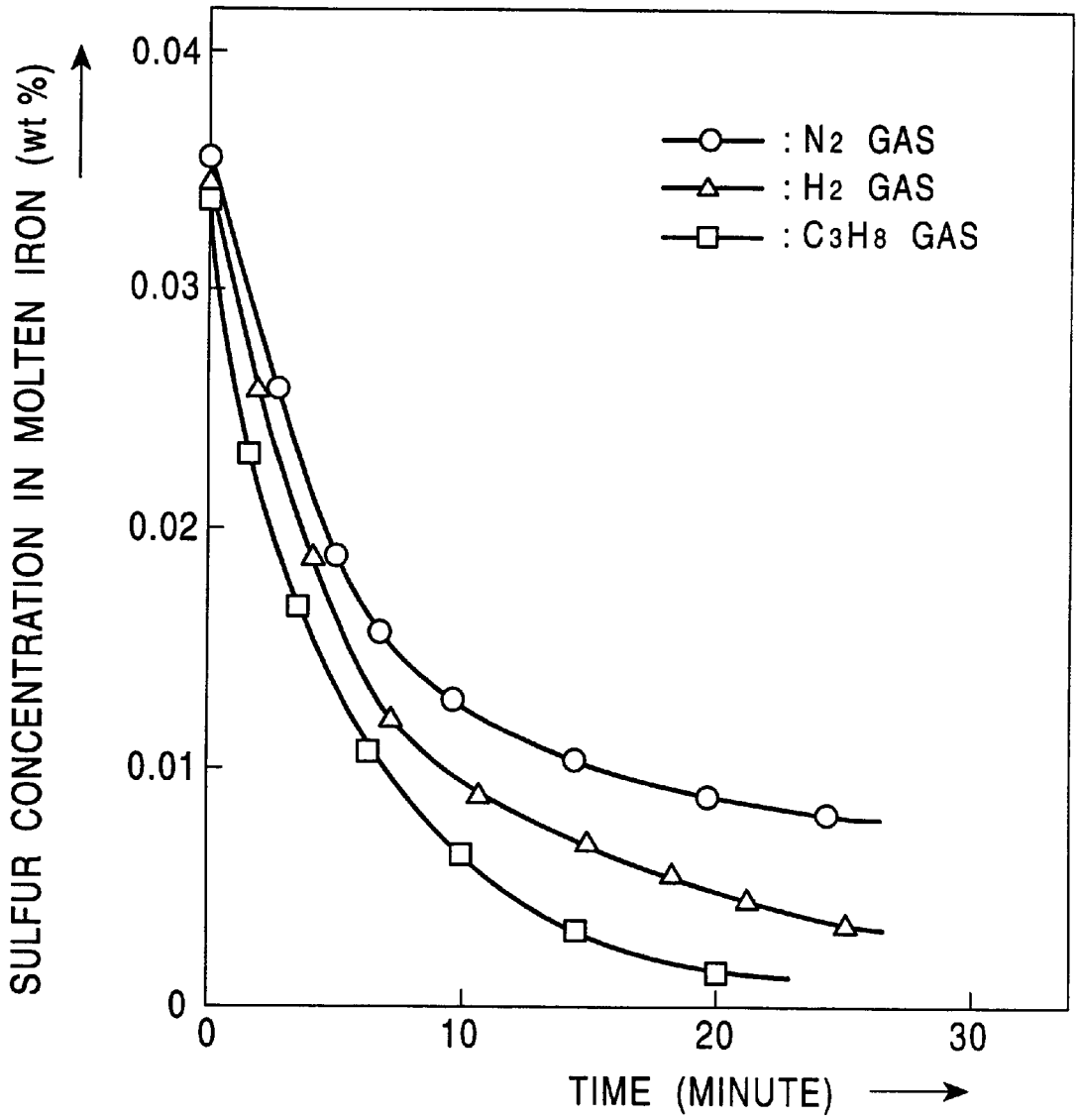
FIG. 4 is a graph showing a change of the sulfur content in molten iron over time.

A change of the sulfur concentration in molten iron over time was studied by employing, as a carrier gas, a $N_2$ gas, $H_2$ gas, and propane ($C_3H_8$) gas, the latter being one example of a hydrocarbon-based gas. Results of the studies are shown in FIG. 4. It is seen from FIG. 4 that the desulfurizing rate is improved by blowing the propane gas into the molten iron. In any of the experiments, the supply rate of a flux was set to be constant.

More specifically, as the sulfur concentration in the molten iron decreases with the progress of the desulfurizing reaction, the desulfurization efficiency obtained with the $H_2$ gas and the $C_3H_8$ gas increases. In a low-sulfur range where the sulfur concentration in the molten iron is less than 0.01 wt %, the difference in the desulfurization efficiency becomes especially noticeable. Also, it has been understood that using the $C_3H_8$ gas, as the carrier gas, provides a greater desulfurizing rate in the low-sulfur range than using the $H_2$ gas.

In the experiments, no difference was found in temperature drop during the desulfurizing process between the different conditions, and a temperature drop occurred at the same level.

As described above, the inventors discovered for the first time the fact that the desulfurizing effect of a hydrocarbon-based gas is enhanced when the sulfur concentration level of molten iron is lowered and the desulfurizing rate is reduced correspondingly as a general rule.

The desulfurizing reaction is basically a reaction between a CaO-based flux, which is a solid material, and sulfur. Therefore, the oxygen potential at the reaction interface greatly affects the reaction rate.

In desulfurization of molten iron, it has been generally thought that the oxygen potential of the system is determined by the C content with respect to Fe in the molten iron where C is already in a saturated state, and the oxygen potential is constant. From the experiment results showing a difference in the desulfurization efficiency depending on the kind of carrier gas, however, the inventors made an entirely new finding that the oxygen potential of the system is determined depending on a simultaneous 3-phase state of the flux, carrier gas and molten iron, including the atmosphere under which the flux is blown in, and especially that the oxygen potential of the carrier gas remarkably affects the desulfurizing reaction.

Then, as is apparent from the experimental results, the effect of the oxygen potential of the carrier gas is increased in the low-sulfur range where the desulfurizing rate is reduced.

From the standpoint of the desulfurizing reaction, therefore, when blowing a flux into molten iron with a carrier gas, it is thought as being the best manner to mix a hydrocarbon-based gas in the carrier gas.

If the carrier gas were entirely a hydrocarbon gas, this would be advantageous in reducing the oxygen potential, but it would give rise to the drawback that the flow rate of the carrier gas cannot be changed to a large extent during the process because of transport characteristics of the flux in the form of powder.

Also, as seen from FIG. 4, continuing supply of a large amount of the hydrocarbon-based gas at all times, including the range where the sulfur concentration in the molten iron is not less than 0.01 wt % and the effect of the hydrocarbon-based gas is comparatively small, results in an increased cost of the hydrocarbon-based gas and hence is not preferred.

In other words, for efficiently utilizing the effect of accelerating the desulfurization by the hydrocarbon-based gas, it is most effective to mix no hydrocarbon-based gas or a small amount thereof in the range where the sulfur concentration in the molten iron is not less than 0.01 wt %, and to increase a proportion of the hydrocarbon-based gas or replace the carrier gas totally by the hydrocarbon-based gas in the range where the sulfur concentration in the molten iron is less than 0.01 wt %.

A hydrogen gas can also be used instead of the hydrocarbon-based gas, but the hydrogen gas is inferior to the hydrocarbon-based gas in the following points.

(1) The hydrogen gas provides a smaller desulfurizing rate in the low-sulfur range than the hydrocarbon-based gas.
(2) In-a steel manufacturing factory including a converter, a propane gas employed as a gas for cooling an oxygen blowing tuyere at the furnace bottom can also be used as the hydrocarbon-based gas.
(3) A gas generated in a coke furnace during the pig-iron manufacturing process can also be used as the hydrocarbon-based gas.
(4) Hydrogen has a higher possibility of explosion by reaction with oxygen than the hydrocarbon-based gas.

From the above reasons, using the hydrocarbon-based gas is more preferable and advantageous than using the hydrogen gas.

Although a $C_3H_8$ gas is employed as the hydrocarbon-based gas in the embodiment, a $CH_4$ gas or a C gas generated from a coke furnace may be employed instead.

The carrier gas is not limited to an $N_2$ gas, but may be any other inert gas such as Ar.

Further, any type of smelting container can be used so long as it allows the hydrocarbon-based gas and the CaO-based flux to be blown into the molten iron at the same site.

As the desulfurizing flux, a flux containing CaO as a main component is optimum because it is inexpensive and facilitates slag treatment after the desulfurizing process.

In addition to CaO that is a main component contributing to the desulfurizing reaction, there may be added, as required, $CaCO_3$ that produces CaO upon pyrolysis and promotes dispersion of the flux into the molten iron, $CaF_2$ and $CaCl_2$ that promote the production of slag from the flux, C and A1 that keep the molten iron in a reducing condition around the blown-in flux, etc.

$Na_2CO_3$ that is a similar oxide-based desulfurizing flux is also usable.

Furthermore, Mg can also be used especially for extremely-low-sulfur steel. The metal Mg is effective to prevent oxidation loss due to the generation of a reducing atmosphere by the hydrocarbon-based gas, and to develop the desulfurizing reaction with priority. A flux containing the metal Mg can also be used.

For blowing the flux into the molten iron, there are, by way of example, a method of employing a lance immersed into the molten iron held in a torpedo car, a molten-iron pan or the like, and a method of blowing the flux through a bottom-blown tuyere into a smelting furnace such as a converter. As a matter of course, any of those methods is usable.

Figure 1:
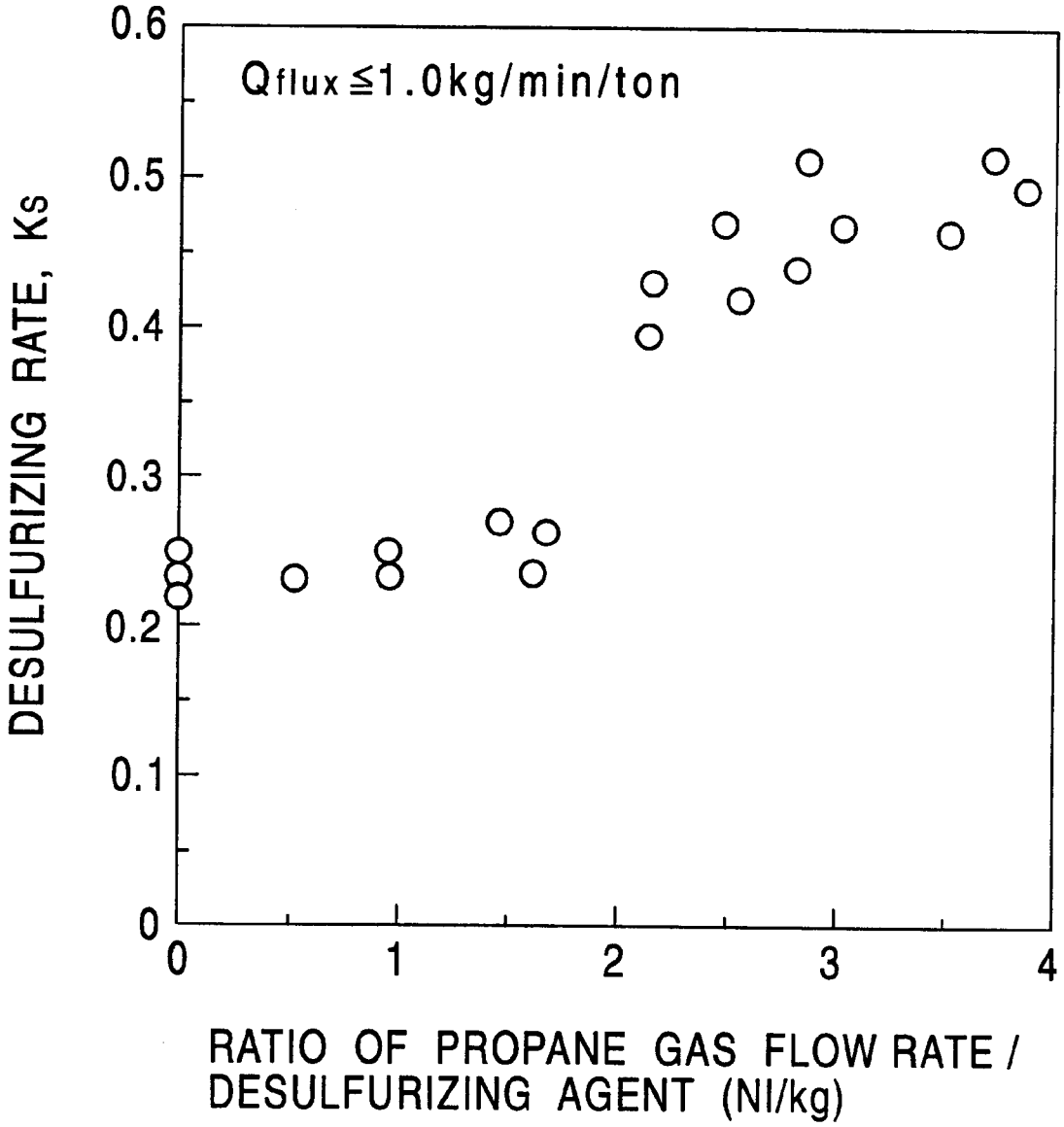
FIG. 1 is a graph showing the relationship between a ratio of propane gas flow rate/desulfurizing agent and a desulfurizing rate under first desulfurizing agent flow rate conditions.
Figure 2:
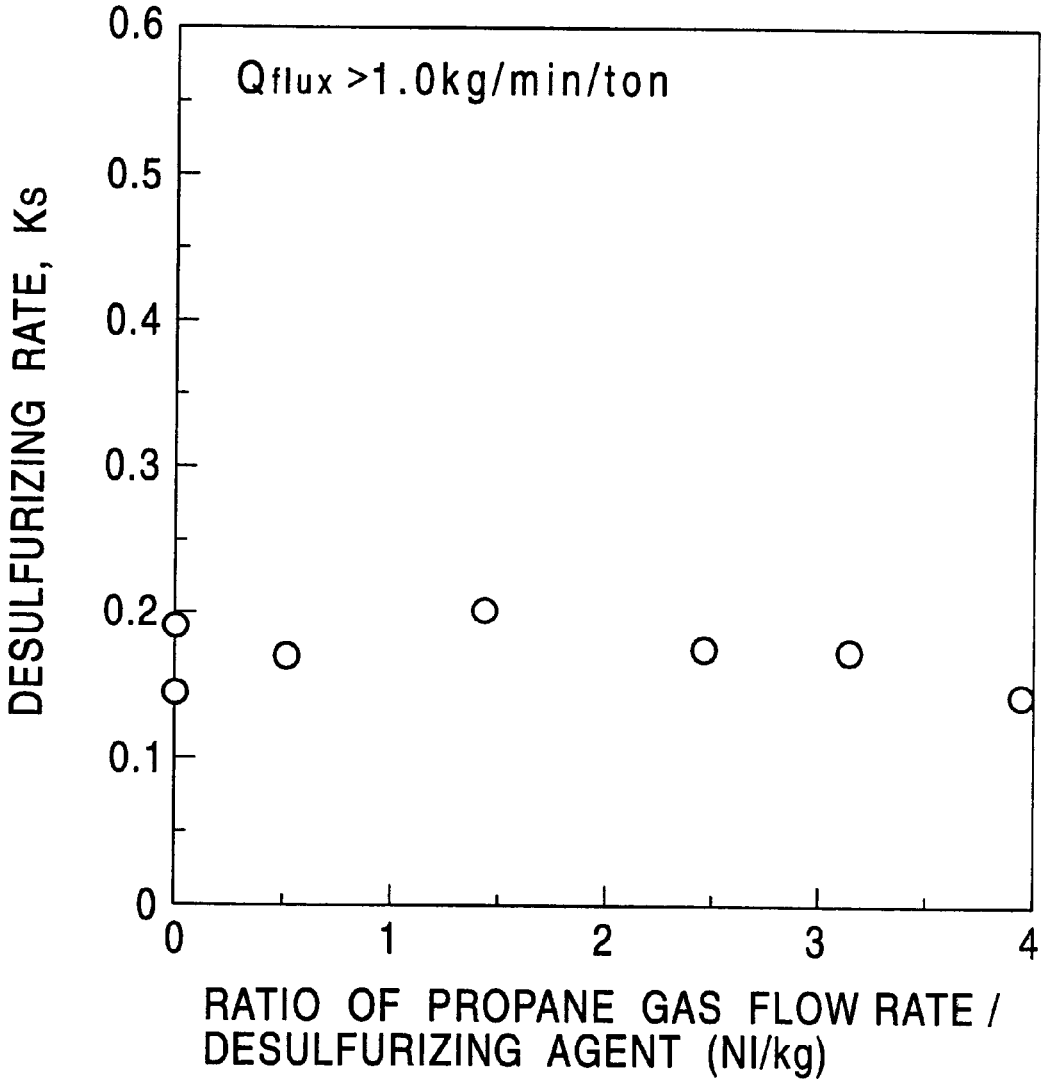
FIG. 2 is a graph showing the relationship between a ratio of propane gas flow rate/desulfurizing agent and a desulfurizing rate under second desulfurizing agent flow rate conditions.

Next, the relationship between a ratio of the propane gas to the desulfurizing agent (i.e., propane gas flow rate/desulfurizing agent (Nl/kg)) and a desulfurizing rate was measured to study how the flow rate of the propane gas and the blowing rate of the desulfurizing agent affect the desulfurizing rate. Experiment conditions are listed in Table 2 and experiment results are shown in FIGS. 1 and 2. The desulfurizing rate $K_s$, is determined by mass transfer to sulfur in the molten iron, and hence is calculated by the following equation (5):

$$K_s, (\text{kg/t})^{-1} = 1n\ ([\%\ S]_f/[\%\ S]_i)W_{flux} \quad (5)$$

where $[\%\ S]_1$: sulfur content (wt %) in molten iron before the desulfurizing process $[\%\ S]_f$: sulfur content (wt %) in molten iron after the desulfurizing process $W_{flux}$: amount (kg/t) of desulfurizing agent added per ton of the molten iron FIG. 1 is a graph showing the relationship between the ratio of propane gas flow rate/desulfurizing agent (Nl/kg) and the desulfurizing rate $K_s$ when the blowing rate $Q_{flux}$, of the desulfurizing agent is not greater than 1.0 kg/minute per ton of the molten iron. FIG. 2 is a graph showing the relationship-between the ratio of propane gas flow rate/desulfurizing agent (Nl/kg) and the desulfurizing rate $K_s$ when the blowing rate $Q_{flux}$ of the desulfurizing agent is greater than 1.0 kg/minute per ton of the molten iron.

As seen from FIG. 1, when the blowing rate $Q_{flux}$ of the desulfurizing agent is not greater than 1.0 kg/minute per ton of the molten iron, the propane gas accelerates the desulfurizing reaction in the range where the ratio of the propane gas to the desulfurizing agent (i.e., propane gas flow rate/desulfurizing agent) is not smaller than 2.0 Nl/kg. The reason why the propane gas accelerates the desulfurizing reaction is that the presence of propane lowers the oxygen potential at the reaction interface between the molten iron and the desulfurizing agent.

Also, in the range where the ratio of the propane gas to the desulfurizing agent is greater than 50 Nl/kg, a reduction in the desulfurizing rate and clogging at the forward end of the lance were found. These phenomena are presumably attributable to a temperature drop that occurs upon the decomposing reaction of hydrocarbon in an area (including the molten iron and the forward end of the lance) of the decomposing reaction to which the desulfurizing agent is blown in.

On the other hand, as seen from FIG. 2, when the blowing rate $Q_{flux}$ of the desulfurizing agent is greater than 1.0 kg/minute per ton of the molten iron, the desulfurizing rate is not improved even in the range where the ratio of the propane gas to the desulfurizing agent (i.e., propane gas flow rate/desulfurizing agent) is not smaller than 2.0 Nl/kg. This is because the effect of hydrocarbon is not sufficiently developed at the reaction interface for the reasons of insufficient dispersion of the desulfurizing agent into the molten iron and the small reaction interface between the molten iron and the desulfurizing agent.

From the above results, it is apparent that the 3-phase coexisting state of the molten iron, desulfurizing agent and gas remarkably affects the desulfurizing reaction. Also, it is desired that the ratio of the propane gas to the desulfurizing agent (i.e., propane gas flow rate/desulfurizing agent) be not smaller than about 2.0 Nl/kg but not greater than about 50 Nl/kg, and that the blowing rate $Q_{flux}$ of the desulfurizing agent is not greater than about 1.0 kg/minute per ton of the molten iron.

More preferably, the ratio of the propane gas to the desulfurizing agent is not smaller than about 2.0 Nl/kg but not greater than about 35 Nl/kg.

As a base carrier gas, $N_2$ is preferably supplied at a flow rate not smaller than about 5 Nl/kg per ton of the molten iron. The reason is to maintain the effects of agitating the molten iron and promoting dispersion of the desulfurizing agent into the molten iron.

In the experiments for the measurement of FIGS. 1 and 2, a noticeable temperature drop of the molten iron was not found during the desulfurizing process. This fact shows that, since the propane gas is blown in a small amount, the temperature of the molten iron is hardly lowered by the effect of decomposing reaction heat (i.e., heat absorption) of the propane gas. Thus, by appropriately setting the amount of hydrocarbon and the supply condition of the desulfurizing agent, the desulfurizing reaction can be accelerated without causing a temperature drop of the molten iron.

Example 1

Figure 3:
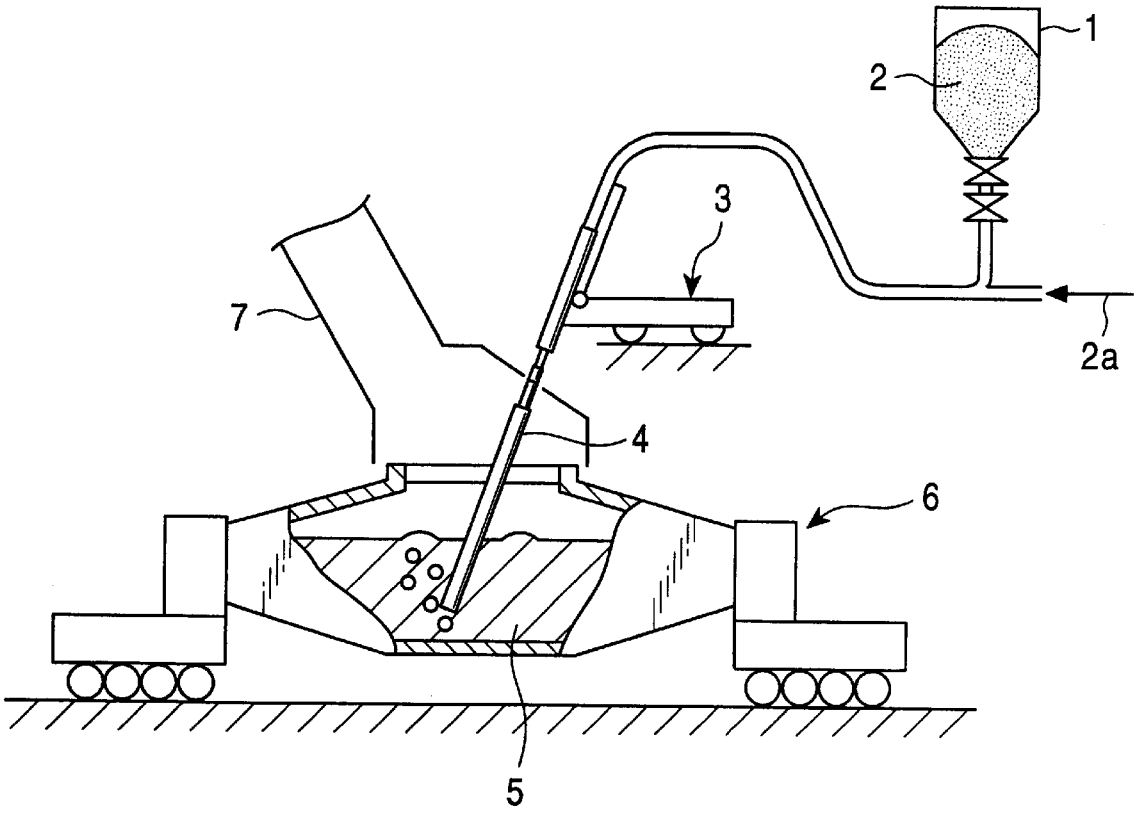
FIG. 3 is a schematic view showing an example of a desulfurizing apparatus.

The desulfurizing process was performed by using a torpedo car 6 with a capacity of 250 tons. A schematic construction of a desulfurizing apparatus is shown in FIG. 3. A powdered desulfurizing agent 2 in a hopper 1 is blown into molten iron 5 through a lance 4 together with a carrier gas 2*a*. The desulfurizing agent used in this Example, the particle size thereof, and the lance immersion depth are listed in Table 3. The desulfurizing conditions such as the blowing rates of the carrier gas and the desulfurizing agent are as shown in Table 4.

Comparative Example 1 represents the case where an $N_2$ gas was used as the sole carrier gas. Comparative Example 2 represents the case where a gas mixture of an $N_2$ gas and a propane gas was used as the carrier gas and the ratio of the propane gas to the desulfurizing agent was relatively small. Comparative Example 3 represents the case where a gas mixture of an $N_2$ gas and a propane gas was used as the carrier gas and the blowing rate of the desulfurizing agent was relatively large. In these Comparative Examples 1 to 3, the desulfurizing rate $K_s$ was in the range of 0.08–0.16.

On the other hand, the desulfurizing rate $K_s$ in the present invention was 0.44, which is substantially and unexpectedly greater than the desulfurizing rates in the Comparative Examples 1 to 3.

While a propane gas (i.e., $C_3H_8$ gas) was employed as the hydrocarbon-based gas in this Example, a similar advantage can also be obtained by using another hydrocarbon-based gas (e.g., $CH_4$ gas) or a gas (so-called C gas) generated from a coke furnace. Also, while an $N_2$ gas was employed in this Example as an inert gas mixed with the hydrocarbon-based gas to prepare the carrier gas, another inert gas (e.g., Ar gas) may be used instead.

While a torpedo car was employed as a container for the molten iron in this Example, any type of smelting container may be used so long as it has a construction allowing the carrier gas and the desulfurizing agent to be blown into the molten iron at the same position.

In the desulfurizing apparatus schematically shown in FIG. 3, the powdery desulfurizing agent 2 in the hopper 1 was blown into molten iron 5 through the lance 4 together with the carrier gas 2*a*. However, the hydrocarbon-based gas such as propane may be separately supplied in an independent manner by providing an inlet near a connecting portion between the lance and a hose extended from the hopper 1. In other words, the separately supplied hydrocarbon gas may be mixed with the desulfurizing agent 2 gas feed together with the carrier gas 2*a* just before the lance 4, and the mixed gases may be blown into the molten iron 5 through the lance 4. This modification is advantageous in that the supply amount of the hydrocarbon-based gas can be changed without affecting the gas-feed characteristics of the desulfurizing agent.

With the present invention, in a desulfurizing process, it is possible to improve the productivity of the molten-iron preliminary treatment, reduce the amount of the desulfurizing agent used, and to cut down the cost due to a reduction in the amount of slag generated.

Example 2

An actual machine test for the present invention was performed by using a 250-ton torpedo car to study the effect of a gas mixture upon the desulfurizing rate. FIG. 3 schematically shows the torpedo car used in the actual machine test.

Referring to FIG. 3, a desulfurizing flux 2 (flux containing CaO as a main component) stored in a raw material hopper 1 was mixed with a carrier gas 2*a*, and a resulting mixture was blown into molten iron 5 in the torpedo car 6 through a top-blown lance 4. The blown lance 4 is held on a lance fixed carriage 3. Numeral 7 denotes a dust collecting hood.

Table 5 shows implementation conditions of the actual machine test for the present invention, and Table 6 shows supply conditions of the carrier gas in implementation of the actual machine test. Table 6 also shows the conditions of Comparative Examples 1 and 2 for comparison with the Example of the present invention.

Comparative Example 1 represents the case where the CaO-based flux was blown with an $N_2$ carrier gas. Comparative Example 2 represents the case where the same flux was blown with a $C_3H_8$, carrier gas. In the Example of the present invention, the same flux was first blown together with a mixed carrier gas of $N_2$ and propane, and the flow rate of the propane gas was increased in a later period of the desulfurizing process.

Table 6 shows the flow rate conditions of the carrier gas in respective periods, and Table 7 shows test results.

With the method of the present invention, the desulfurization efficiency per unit amount of the flux is improved with a lesser flow rate of the propane gas than that in Comparative Example 2.

The temperature of the molten iron was not changed significantly depending on the flow rate of the propane gas.

According to the present invention, as described above, the desulfurizing rate in the process of desulfurizing molten iron, particularly, the desulfurizing rate in the low-sulfur range, can be efficiently accelerated with a small amount of reducing gas. It is therefore possible to realize an improvement of productivity in the molten-iron preliminary treatment and a cost reduction due to cut-down in the amount of a desulfurizing flux used.

TABLE 1

| 4-ton furnace Experiment conditions | |
|---|---|
| Amount of molten iron | 4.5 ton |
| Flux (Powder) | |
| Component | $CaF_2$: 2 weight %<br>Coke: 5 weight %<br>CaO: Balance |
| Particle size | Less than 100 $\mu$m |
| Powder blowing rate | 1.5 Kg/minute |
| Gas blowing rate | 0.05 $Nm^3$/minute |
| Lance immersion depth | 700 mm |

TABLE 2

| | |
|---|---|
| Amount of molten iron | 4.5 ton |
| Desulfurizing agent | CaO + 2 weight % $CaF_2$ |
| Particle size of desulfurizing agent | Less than 100 $\mu$m |
| Blowing rate of desulfurizing agent | 1.5 to 10 kg/minute |
| Base carrier gas | $N_2$ 200 Nl/minute |
| Added carrier gas | One of $N_2$ and $C_3H_8$ at 6–40 Nl/minute |
| Lance immersion depth | 700 mm |

TABLE 3

| | |
|---|---|
| Desulfurizing agent | CaO + 2 weight % $CaF_2$ |
| Particle size of desulfurizing agent | Less than 100 $\mu$m |
| Lance immersion depth | 1000 mm |

TABLE 4

| | Weight of molten iron (t) | Carrier gas | Blowing rate of desulfurzing agent (kg/min) | Propane gas flow rate ($Nm^3$/min) | $N_2$ gas flow rate ($Nm^3$/min) | Propane gas flow rate/ Desulfurizing agent (Nl/kg) | Per 1 ton of molten iron: Blowing rate of desulfurizing agent (kg/min) | Per 1 ton of molten iron: Amount of blown desulfurizing agent (kg/t) | Sulfur content in molten iron (weight %): Before desulfurization | Sulfur content in molten iron (weight %): After Desulfurization | Desulfurizing rate Ks $(kg/t)^{-1}$ |
|---|---|---|---|---|---|---|---|---|---|---|---|
| Comparative Example 1 | 246 | $N_2$ | 150 | — | 4.3 | — | 0.6 | 8.1 | 0.038 | 0.010 | 0.16 |
| Comparative Example 2 | 252 | $N_2$ + $C_3H_8$ | 150 | 0.2 | 4.3 | 1.3 | 0.6 | 8.6 | 0.036 | 0.009 | 0.16 |
| Comparative Example 3 | 255 | $N_2$ + $C_3H_8$ | 350 | 1.5 | 4.3 | 4.3 | 1.4 | 21.0 | 0.040 | 0.008 | 0.08 |
| Inventive Example | 250 | $N_2$ + $C_3H_8$ | 150 | 0.8 | 4.3 | 5.3 | 0.6 | 8.4 | 0.040 | 0.001 | 0.44 |

TABLE 5

| (Actual machine) Torpedo car experiment conditions | |
|---|---|
| Amount ot molten iron | 250 ton |
| Flux (Powder) | |
| Component | $CaF_2$: 2 weight %<br>Coke: 5 weight %<br>CaO: Balance |
| Particle size | Less than 100 $\mu$m |
| Powder blowing rate | 85 Kg/minute |
| Lance immersion depth | 1500 mm |

TABLE 6

| Case | Kind of carrier gas | Flow rate in period of start to 10 minutes: $N_2$ | Flow rate in period of start to 10 minutes: $C_3H_8$ | Flow rate in period of 10 to 20 minutes: $N_2$ | Flow rate in period of 10 to 20 minutes: $C_3H_8$ | Total flow rate: $N_2$ | Total flow rate: $C_3H_8$ |
|---|---|---|---|---|---|---|---|
| Comparative example 1 | $N_2$ | 2.5 | — | 2.5 | — | 50.0 | — |
| Comparative example 2 | $C_3H_8$ | — | 2.5 | — | 2.5 | — | 50.0 |
| Inventive example | $N_2$ + $C_3H_8$ | 2.0 | 0.5 | 0.5 | 2.0 | 25.0 | 25.0 |

[Notes]
Unit of flow rate: $Nm^3$/min
Unit of total flow rate: $Nm^3$/ch

TABLE 7

| Case | Weight of molten iron (ton) | Amount of flux (kg/t) | Sulfur concentration in molten iron (wt %): Before treatment | Sulfur concentration in molten iron (wt %): After treatment | Temperature of molten iron (° C.): Before treatment | Temperature of molten iron (° C.): After treatment |
|---|---|---|---|---|---|---|
| Comparative example 1 | 246 | 7.2 | 0.038 | 0.008 | 1320 | 1275 |
| Comparative | 252 | 6.9 | 0.036 | 0.005 | 1311 | 1270 |

TABLE 7-continued

| Case | Weight of molten iron (ton) | Amount of flux (kg/t) | Sulfur concentration in molten iron (wt %): Before treatment | Sulfur concentration in molten iron (wt %): After treatment | Temperature of molten iron (° C.): Before treatment | Temperature of molten iron (° C.): After treatment |
|---|---|---|---|---|---|---|
| example 1 Inventive example | 255 | 6.5 | 0.040 | 0.001 | 1309 | 1276 |

What is claimed is:

1. A method of desulfurizing molten iron, comprising blowing into a molten iron a desulfurizing agent comprising a powdered solid oxide and a carrier gas, wherein the carrier gas is a mixture of an inert gas and a hydrocarbon gas, and wherein a ratio of the hydrocarbon gas to the desulfurizing agent is in the range of from about 2.0 to about 50 Nl/kg.

2. The method according to claim 1, wherein a blowing rate of said desulfurizing agent is at most about 1.0 kg/minute per ton of the molten iron.

3. The method according to claim 2, wherein said powdered solid oxide comprises CaO.

4. A method of desulfurizing molten iron, comprising blowing into molten iron a desulfurizing flux together with a carrier gas, thereby to remove sulfur in the molten iron, wherein the carrier gas is at least initially a mixture of an inert gas and a hydrocarbon gas; and changing the composition of the carrier gas over the course of desulfurization such that relatively more hydrocarbon gas is used in a later stage of desulfurization than in an earlier stage.

5. The method according to claim 4, wherein said carrier gas no longer contains said inert gas during said later stage of desulfurization.

6. The method according to claim 4, wherein said later stage of desulfurization is commenced upon the sulfur content of the molten iron decreasing to or below a predetermined value below which the desulfurization is effectively accelerated by the hydrocarbon gas.

7. The method according to claim 4, wherein said later stage of desulfurization is commenced upon the sulfur content of the molten iron decreasing to or below about 0.01 wt %.

8. A method of desulfurizing molten iron, comprising blowing a desulfurizing flux into molten iron together with a carrier gas, thereby to remove sulfur in the molten iron, wherein said carrier gas is initially an inert gas; and adding a hydrocarbon gas to said inert gas, or replacing said inert gas altogether by said hydrocarbon gas, when a sulfur concentration in the molten iron is reduced to or below a predetermined value below which the desulfurization is effectively accelerated by the hydrocarbon gas.

9. A method of desulfurizing molten iron, comprising blowing a desulfurizing flux into molten iron together with a carrier gas, thereby to remove sulfur in the molten iron, wherein said carrier gas is initially an inert gas; and adding a hydrocarbon gas to said inert gas, or replacing said inert gas altogether by said hydrocarbon gas, when a sulfur concentration in the molten iron is reduced to or below about 0.01 wt %.

* * * * *